United States Patent [19]

Igarashi et al.

[11] Patent Number: 4,970,869

[45] Date of Patent: Nov. 20, 1990

[54] TUBE TYPE FREEZING UNIT AND IN-TUBE FREEZING METHOD

[75] Inventors: Seishiro Igarashi; Tetsuya Nakatsuji, both of Tokyo, Japan

[73] Assignee: Shimizu Construction Co., Ltd., Tokyo, Japan

[21] Appl. No.: 436,985

[22] Filed: Nov. 15, 1989

[30] Foreign Application Priority Data

Jan. 13, 1989 [JP] Japan ..... 1-6656

[51] Int. Cl.[5] ..... F25D 3/00

[52] U.S. Cl. ..... 62/59; 62/330

[58] Field of Search ..... 62/330, 348, 352, 73, 62/347

[56] References Cited

U.S. PATENT DOCUMENTS

| | | | |
|---|---|---|---|
| 3,068,660 | 12/1962 | Council et al. | 62/352 X |
| 3,206,945 | 12/1965 | Nilsson et al. | 62/352 |
| 3,759,061 | 9/1973 | Nelsson et al. | 62/348 X |
| 3,877,242 | 4/1975 | Creager | 62/352 X |
| 4,401,449 | 8/1983 | Martin et al. | 62/330 X |
| 4,625,525 | 12/1986 | Bradbury et al. | 62/330 |
| 4,671,077 | 6/1987 | Paradis | 62/59 |
| 4,833,897 | 5/1989 | Burns | 62/330 |
| 4,838,039 | 6/1989 | Knodel | 62/330 |

*Primary Examiner*—William E. Tapolcai

*Attorney, Agent, or Firm*—Armstrong, Nikaido, Marmelstein, Kubovcik & Murrat

[57] ABSTRACT

A tube type freezing unit of the present invention employs as a low-temperature heat accumulating material an aqueous solution of bromide of a low concentration. A plurality of thin tubes are accommodated in a shell, and a non-freezing liquid or a refrigerant is passed into the shell around the tubes. A sherbet-like slush is generated in a freezing mode by filling the tubes with the aqueous solution of bromide of a low concentration which serves as the low-temperature heat accumulating solution and then by passing a non-freezing liquid having a temperature of about −5° C. or a refrigerant whose vaporization temperature is about −5° C. around the tubes which contain the aqueous solution of bromide in a stationary state. The aqueous solution of bromide does not freeze. So, the sherbet-like slush is generated in the solution. An aqueous solution of bromide of a low concentration has a freezing point of about −1° C. In consequence, a non-freezing liquid or a refrigerant can be used as a relatively high temperature.

7 Claims, 7 Drawing Sheets

TUBE TYPE FREEZING UNIT AND IN-TUBE FREEZING METHOD

BACKGROUND OF THE INVENTION

1. Field of the Invention

The present invention relates to a tube type freezing unit of the type in which sherbet-like slush is made from a low-temperature heat accumulating solution filling a plurality of thin tubes disposed within a shell, and an intube freezing method therefor.

2. Description of the Related Art

An icy low-temperature heat accumulating system is more advantageous than a liquid low-temperature heat accumulating system in that it can be made compact due to its small heat-accumulating capacity. Since bulky ice is not easy to convey, the icy low-temperature heat accumulating system makes and employs slush, which has a high fluidity and which can be conveyed easily.

Conventional icy low-temperature heat accumulating systems of the type in which slush made within tubes is conveyed to and stored in a low-temperature heat accumulating tank include the thin-film dropping type freezing system, the circulatory freezing system, the freezing system which utilizes the supercooling effect of water, and so on.

FIG. 1 shows the conventional freezing system of the thin-film dropping type, and FIG. 2 shows the freezing system which utilizes the supercooling effect of water. In FIGS. 1 and 2, a reference numeral 61 denotes a freezer, 62: a freezer head, 63: a circulating solution receiver, 64: a circulating solution inlet, 65: a circulating solution outlet, 66: a refrigerant outlet, 67: a refrigerant inlet, 68: tubes, 71: a freezer, 72: a brine cooler, 73: a supercooling device, 74: a filter, 75: a low-temperature heat accumulating tank, and 76: a secondary system.

The thin-film dropping type freezing system has been developed by CBI. It employs a longitudinal shell-&-tube type heat exchanger as a freezer, as shown in FIG. 1. The shell is constituted by the flooded, direct expansion type freezer 61 with the tubes 68 incorporated therein. The freezer 61 employs a refrigerant. The refrigerant is introduced into the shell from the refrigerant inlet 67, and is drawn out from the refrigerant outlet 66 in a gaseous form. The inner surface of each of the tubes is specular. An aqueous solution of ethylene glycol which serves as a low-temperature heat accumulating solution is fed to the freezer head 62 from an icy low-temperature heat accumulating tank through the circulating solution inlet 64. When the aqueous solution of ethylene glycol reaches the level of the tubes 68, it flows into the tubes and then drops along the specular inner surfaces of the tubes 68, during which time heat is exchanged between the aqueous solution of ethylene glycol and the refrigerant to cool the aqueous solution of ethylene glycol. This causes the water molecules in the brine to freeze, generating fine icy crystals. The sherbet-like slush thus formed drops to the circulating solution receiver 63 located at the lower portion of the freezer 61. The slush received by the circulating solution receiver 63 is then conveyed to and stored in the icy low-temperature heat accumulating tank.

The circulatory freezing system has been developed by a Canadian company, Sunwell Engineering. In this freezing system, an aqueous solution of ethylene glycol which serves as a low-temperature heat accumulating solution is circulated within the freezing tubes in a jacket which is a direct expansion type evaporator. In this way, a high pressure is generated on the freezing surface located on the outer periphery, and slush is formed at a low-pressure central portion due to the supercooling effect.

The freezing system which utilizes the supercooling effect of water employs the filter 74, as shown in FIG. 2, for the purpose of cleaning the low-temperature heat accumulating solution, which is necessary to maintain unstable supercooling effect of water. It adopts an indirect cooling method by means of a brine, which is required to provide a stable cooling temperature, pressurization within the tubes, and conveyance of the solution at a high speed.

Thus, in the conventional freezing systems, the sherbet-like slush is made by the refrigerator during the low-temperature heat accumulation operation utilizing the characteristics of the aqueous solution of ethylene glycol, and the slush made is stored in the low-temperature heat accumulating tank, the low-temperature heat thus accumulated being released as a low-temperature heat source through a heat exchanger when necessary.

However, the above-described conventional freezing systems have disadvantages in that they have to use the aqueous solution of ethylene glycol which is an industrial waste to achieve a low freezing point and thereby solve the problem involving the attachment of ice on the freezing surface and in that they require large auxiliary power. The freezing system of the type which utilizes the supercooling effect of water requires a large amount of energy and high cost to achieve indirect cooling and to convey the low-temperature heat accumulating solution, which are required to maintain the supercooling effect. These reduce the efficiency of the overall system.

An aqueous solution of ethylene glycol of a low concentration of 10% or less becomes moldy at 30° C. or less. This makes use of the aqueous solution of ethylene glycol as heat-accumulating material for a heating system difficult. Hence, if it is used in a heat pump, heat accumulation has to be suspended in winter, or the aqueous solution of ethylene glycol has to be substituted with plain water. Alternatively, a high-temperature heat accumulating tank has to be provided separately from a low-temperature heat accumulating tank for a cooling system. Furthermore, the aqueous solution of ethylene glycol is designated as an industrial waste, and is therefore generally used indirectly through a heat exchanger. This makes use of it very difficult as a circulating solution for an open type heating tower because of the possibility of the circulating solution scattering and leaking.

In a heating tower system, the water vapor in the air enters the circulating solution to reduce the concentration thereof. Hence, the concentration of a non-freezing liquid in the circulating solution must be increased by operating a heating tower and a pump on days of good weather and low humidity while stopping the operation of the heat pump and thereby thickening the circulating solution by natural evaporation. The circulating solution may also be thickened by heating part of it and thereby causing the water therein to evaporate. Generally, thickening is achieved by heating rather than by the natural evaporation, and this makes the overall system complicated and less efficient.

SUMMARY OF THE INVENTION

An object of the present invention is to provide a tube type freezing unit and an in-tube freezing method which are capable of generating sherbet-like slush at a low cost and which are simple in structure. Another object of the present invention is to provide a tube type freezing unit and an in-tube freezing method which ensures a high efficiency at a relatively high temperature.

To this end, the present invention provides a tube type freezing unit in which a sherbet-like slush is made from a low-temperature heat accumulating solution filling a plurality of thin tubes disposed within a shell. The tube type freezing unit is characterized by the use of an aqueous solution of bromide of a low concentration as the low-temperature heat accumulating solution and by the passing of a non-freezing liquid or a refrigerant around the tubes.

The present invention also provides a freezing method in which sherbet-like slush is produced from a low-temperature heat accumulating solution filling a plurality of thin tubes disposed within a shell by passing a non-freezing liquid or a refrigerant around the tubes. The freezing method is characterized by the use of an aqueous solution of bromide of a low concentration as a low-temperature heat accumulating solution and by the making of the sherbet-like slush in a freezing mode in which a non-freezing liquid having a temperature of about −5° C. or a refrigerant whose vaporization temperature is about −5° C. is passed around the tubes which contain the aqueous solution of bromide in a stationary state.

The tube type freezing unit and the in-tube freezing method according to the present invention employ as the low-temperature heat accumulating solution an aqueous solution of bromide of a low concentration which has a strong osmotic pressure (hydrating property) and which exhibits depression of the freezing point whose level is determined by the concentration thereof. As bromide is discharged, as the consequence of the generation of slush, it enters the solution, thereby increasing the concentration of the aqueous solution of bromide and lowering the freezing point thereof. This results in the generation of a sherbet-like slush mixed in the aqueous solution of bromide which is not frozen. Furthermore, since an aqueous solution of bromide of a low concentration has a freezing point of about −1° C., a non-freezing liquid or a refrigerant can be used at a higher temperature than that at which it is used conventionally when the freezing point of the low-temperature heat accumulating solution is about −5° C. Furthermore, since the low-temperature heat accumulating solution filling the tubes is frozen in a stationary state, power required for charging the low-temperature heat accumulating solution is unnecessary during the freezing.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENTS

Figure 3:
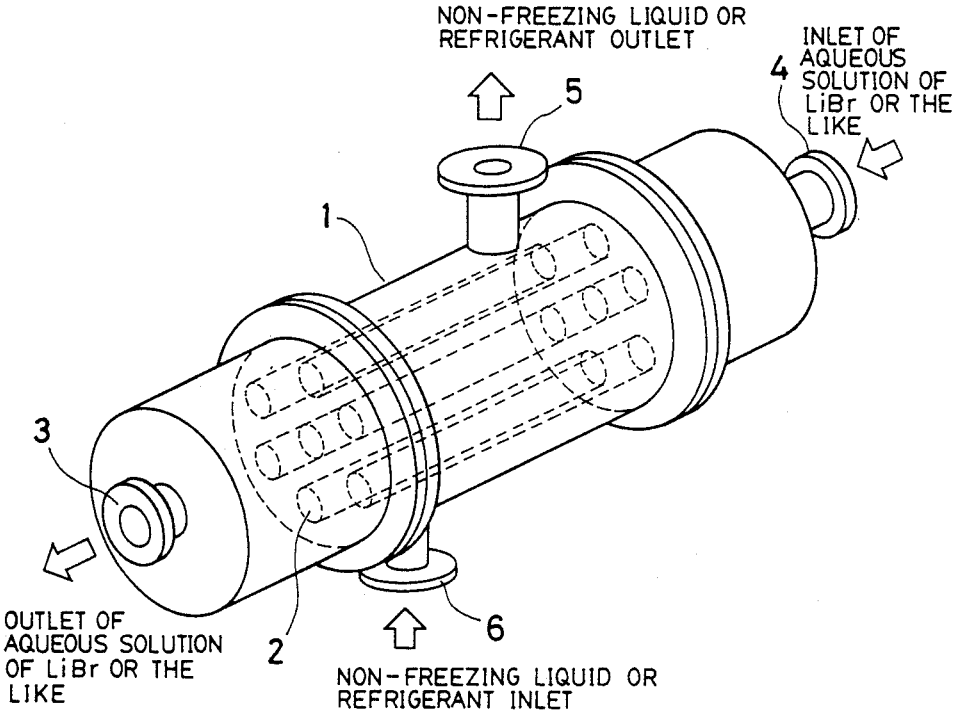
FIG. 3 is a schematic view of a first embodiment of a tube type freezing unit according to the present invention.
Figure 4:
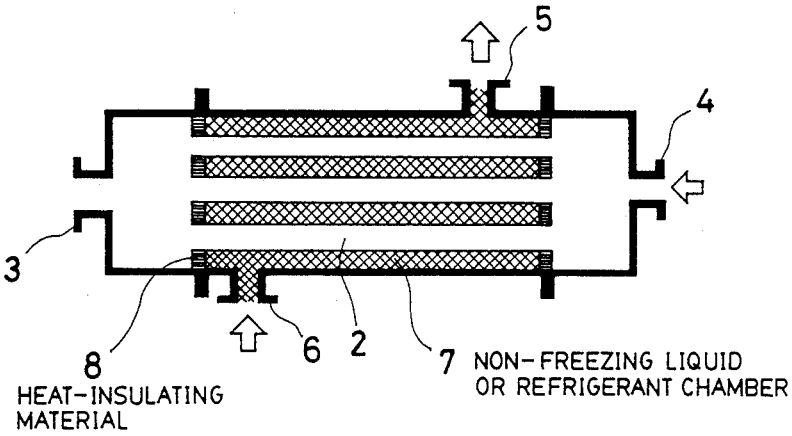
FIG. 4 is a cross-sectional view of the freezing unit of FIG. 3.
Figure 5:
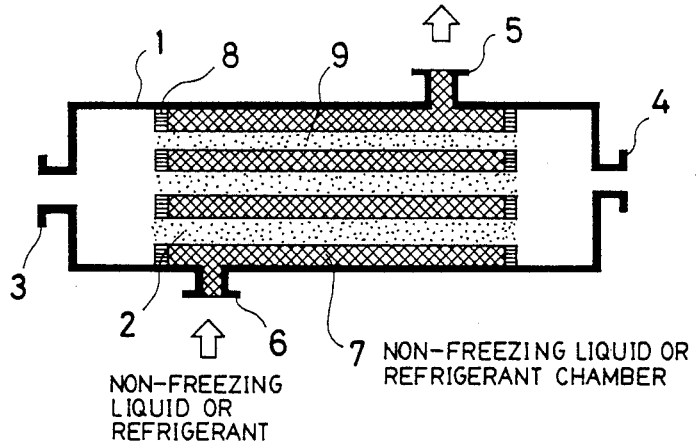
FIGS. 5(*a*), 5(*b*) and 5(*c*) illustrate freezing mode and slush-discharging mode.
Figure 5:
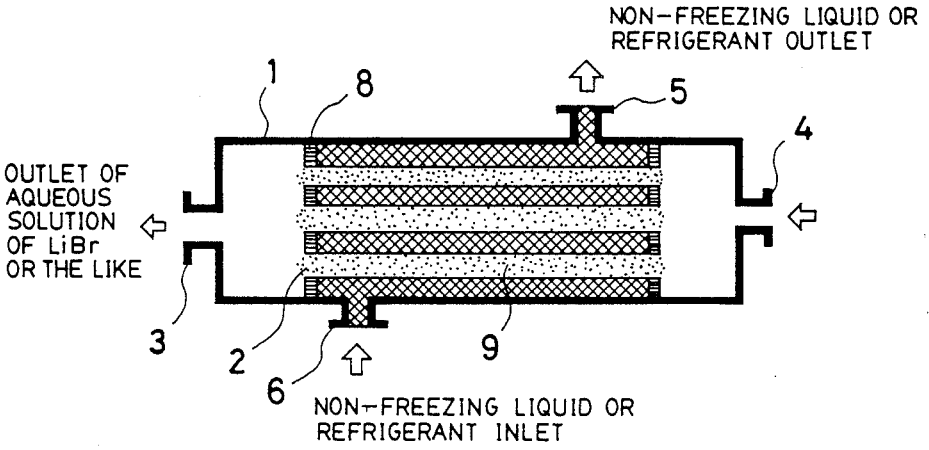
Figure 5:
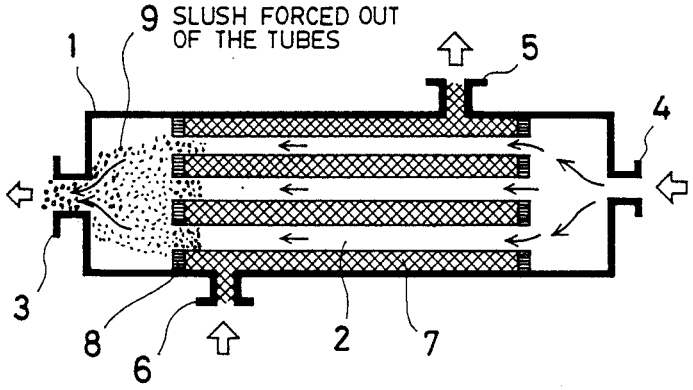

In FIGS. 3 to 5, a reference numeral 1 denotes a shell, 2; tubes, 3; a low-temperature heat accumulating solution outlet, 4; a low-temperature heat accumulating solution inlet, 5; a non-freezing liquid or refrigerant outlet, 6; a non-freezing liquid or refrigerant inlet, 7; a non-freezing liquid or refrigerant chamber, 8; a heat-insulating material, and 9; a sherbet-like slush.

A tube type freezing unit according to the present invention employs a shell-&-tube type freezer in which a plurality of thin tubes (coils) 2 are accommodated in a shell 1, as shown in FIG. 3. It employs as a low-temperature heat accumulating material (also called a cold heat accumulating material) an aqueous solution of bromide, such as lithium bromide, of a low concentration. The aqueous solution of bromide is introduced into the tubes 2 accommodated in the shell 1 from the inlet 4 of the aqueous solution of bromide, and a non-freezing liquid or a refrigerant is introduced into the shell around the tubes 2 from the non-freezing liquid or refrigerant inlet 6 so as to cool the tubes 2 and thereby generate sherbet-like slush from the aqueous solution of bromide contained in the tubes in a stationary state. The sherbet-like slush generated is forced out of the outlet 3 of the aqueous solution of bromide by the charging of the aqueous solution of bromide from the inlet 4 of the aqueous solution of bromide. As shown in FIG. 4 which is a cross-sectional view of the above-described tube type freezing unit, the plurality of thin tubes 2 are accommodated in the central portion of the shell 1. Each of the thin tubes 2 communicates with the inlet 4 of the aqueous solution of bromide at one end. The other end thereof communicates with the outlet 3 of the aqueous solution of bromide. The interior of the shell 1 is partitioned by the heat-insulating material 8 at the two ends of the tubes 2 so that the space in the shell 1 around the tubes 2 can form the non-freezing liquid or refrigerant chamber 7. The non-freezing liquid or refrigerant chamber 7 is made to communicate with the non-freezing liquid or refrigerant inlet 6 and the non-freezing liquid or refrigerant outlet 5.

Next, the operations of the above-described freezing unit in the freezing mode and the slush-discharging mode will be described below with reference to FIGS. 5 (*a*) to 5(*c*).

In the freezing mode, an aqueous solution of bromide which acts as the low-temperature heat accumulating solution is filled in the tubes 2 and is then made stationary. Thereafter, the non-freezing liquid having a temperature of about −5° C. or the refrigerant whose vaporization temperature is about −5° C. is supplied into the non-freezing liquid or refrigerant chamber 7 from the non-freezing liquid or refrigerant inlet 6 for 5 to 10 minutes to cool the tubes 2. This makes part of the water contents of the aqueous solution of bromide contained in the tubes 2 frozen, thereby generating slush 9, as shown in FIG. 5(*a*).

The present inventors employed an aqueous solution of bromide, such as lithium bromide (LiBr), of a low concentration as the low-temperature heat accumulating solution, and found that the sherbet-like slush 9 could be generated readily at a relatively high temperature without employing an aqueous solution of ethylene glycol or without utilizing the supercooling effect, which were used conventionally. The present inventors consider the reasons for this as follows: Bromide such as lithium bromide has a high hydrating property (is very osmotic to water). An aqueous solution of bromide of a low concentration is characterized in that the freezing point thereof drops (depression of freezing point) as the concentration becomes higher. In consequence, as the aqueous solution of bromide of a low concentration which serves as the low-temperature heat accumulating solution is cooled in a stationary state and thereby made frozen, lithium bromide and so on discharged from the aqueous solution enter uniformly in the aqueous solution of bromide which is not yet frozen due to its strong osmotic pressure, increasing the concentration of the residual aqueous solution of bromide and thereby dropping the freezing point of the aqueous solution accordingly. As a result, even when the temperature of the freezing surface drops to −5° C. or below, the aqueous solution of bromide remains within the tubes 2 in an amount corresponding to its concentration, resulting in the generation of the sherbet-like slush within the overall tubes 2, with no solid plate-like ice formed o the freezing surfaces of the tubes. Moreover, the freezing point of the aqueous solution of bromide of a concentration of several percents (e.g., a concentration of 2 to 3%) is about −1° C., and this enables slush to be generated efficiently at a relatively high temperature.

After the sherbet-like slush has been generated in the manner described above, the operation is switched over to the slush-discharging mode in which the sherbet-like slush is forced out of the tubes 2. In this slush-discharging mode, firstly, the freezing surfaces of the tubes are heated in the vicinity of the freezing point of the aqueous solution of bromide of a low concentration (e.g., at about 0° C. in the case of an aqueous solution of bromide having a concentration of 2 to 3%) for one minute or less (several tens of seconds) using the non-freezing liquid or the refrigerant so as to peel the sherbet-like slush 9 attached to the freezing surfaces by a small adhering force (FIG. 5 (*b*)). Next, the aqueous solution of bromide of a low concentration is pumped from the low-temperature heat accumulating tank for several tens of seconds and then supplied into the tubes 2 to force the mixture of the aqueous solution of bromide and the sherbet-like slush 9 out of the tubes through the outlet 3 of the aqueous solution of bromide into the low-temperature heat accumulating tank (cold heat accumulating tank) and thereby to replace it by the newly supplied aqueous solution of bromide.

Figure 6:
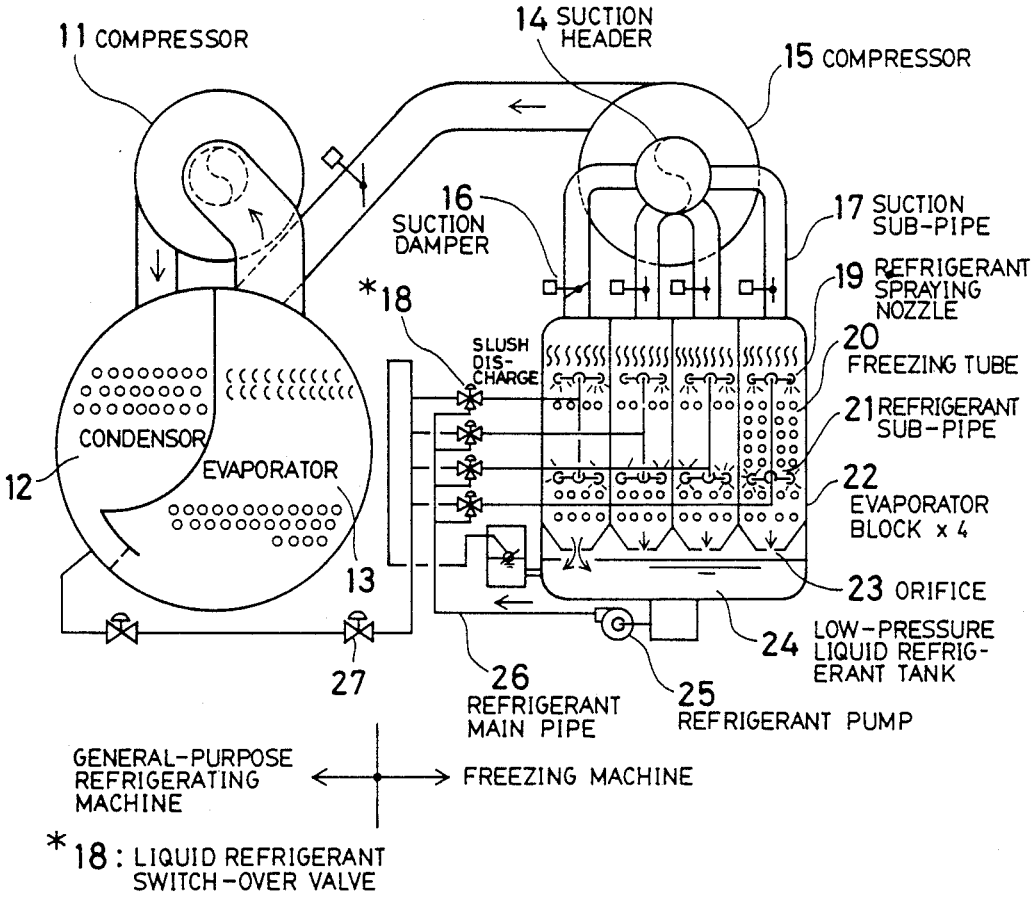
FIG. 6 shows a refrigerant system of a freezing system to which the tube type freezing unit according to the present invention is applied.
Figure 7:
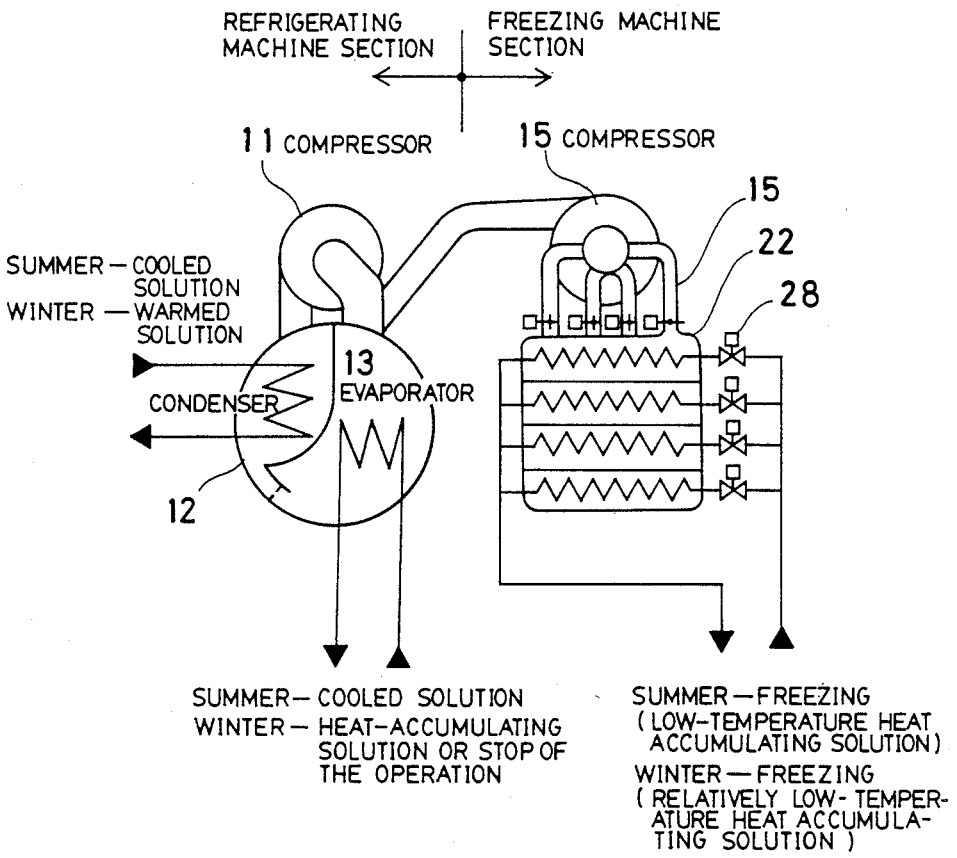
FIG. 7 shows a water system of the freezing system of FIG. 6.

FIGS. 6 and 7 show a system in which a general-purpose refrigerating machine and a freezing machine according to the present invention are formed as one unit. The freezing section incorporates a plurality of tube type freezing units. In FIGS. 6 and 7, reference numerals 11 and 15 denote compressors, 12: a condenser, 13: an evaporator, 14: a suction header, 16: suction dampers, 17: suction sub-tubes, 18: refrigerant switch-over valves, 19: refrigerant spray nozzles, 20: freezing tubes, 21: refrigerant sub-tubes, 22: evaporator blocks, 23: orifices, 24: a low-pressure refrigerant tank, 25: a refrigerant pump, 26: a refrigerant main pipe, 27: refrigerant flow-rate regulating valves, and 28: heat-accumulating solution switch-over valves.

Each of the four evaporator blocks 22 corresponds to the freezing unit shown in FIG. 3. The liquid refrigerant switch-over valves 18 switch over the supply system of the liquid refrigerant between the condenser 12 and the low-pressure liquid refrigerant tank 24 according to the operation mode which is either the freezing mode or the slush, discharging mode. Supply of the low-temperature heat accumulating solution is suspended in the freezing mode by closing the low-temperature heat accumulating solution switch-over valves 28 to make the low-temperature heat accumulating solution within the freezing tubes 29 in the evaporator blocks 22 stationary. The low-temperature heat accumulating solution is supplied into the freezing tubes 20 through the low-temperature heat accumulating solution switch-over valves 28 in the slush-discharging mode to force out the sherbet-like slush and thereby replace it with the low-temperature heat accumulating solution.

During the freezing operation, a high-pressure normal-temperature liquefied refrigerant which is compressed by the compressor 11 and which is condensed by the condenser 12 passes through the refrigerant flow-rate regulating valves 27 and is fed into the freezing section where it is sprayed into the evaporator block 22 which is operating in the slush discharging mode from the refrigerant spray nozzle 19 thereof. The liquefied refrigerant drops through the orifice 23 and stays in the low-pressure liquid refrigerant tank 24 located in the lower portion of that evaporator block 22. The liquefied refrigerant then passes through the refrigerant pump 25, the refrigerant main pipe 26, and the refrigerant switch-over valve 18 and is then sprayed into the evaporator block 22 which is operating in the freezing mode through its refrigerant spray nozzle 19. The liquid refrigerant vaporizes in the evaporator block 22 at about −5° C. The resultant low-temperature and low-pressure refrigerant vapor is sucked by the compressor 15 of the freezing section, and compressed refrigerant gas is returned to the evaporator 13 of the refrigerating section, thus beginning a refrigerating cycle anew.

Thus, since the refrigerant is supplied from the freezing section into the evaporator 13 of the refrigerating section in a gaseous form during the freezing operation, the water contents within the evaporator 13 of the refrigerating section do not freeze. In consequence, the heat-accumulation operation can be smoothly switched over to the cooling water operation which is performed in a daytime.

The low-temperature heat accumulating solution which is pumped from the low-temperature heat accumulating solution tank located in the ground or the like by the low-temperature heat accumulating solution pump is fed into the evaporator block 22 in the freezing section which is operating in the slush-discharging mode through a control valve such as the low-temperature heat accumulating solution switch-over valve 28, where part of it is frozen to form a slush. The slush mixed with the solution is returned to and is stored in the low-temperature heat accumulating solution tank.

In the freezing system shown in FIGS. 6 and 7, slush can be continuously made by controlling opening/closing of the refrigerant switch-over valves 18 and that of the low-temperature heat accumulating solution switch-over valves 28 so that the individual evaporator blocks 22 cyclically repeat the freezing mode and the slush-discharging mode in sequence. In this way, the low-temperature heat accumulating solution switch-over valves 28 are switched over so that supply of the low-temperature heat accumulating solution to the individual evaporator blocks 22 is suspended during the freezing operation for each block and so that the low-temperature heat accumulating solution is supplied into the individual evaporator blocks 22 separately for several tens of seconds in the latter half of the slush-discharging operation to convey the slush generated within the blocks and thereby replace the slush with the low-temperature heat accumulating solution. In consequence, the power required to convey the low-temperature heat accumulating material can be greatly reduced as compared with the conventional freezing machine.

The evaporator block 22 located at the right end as viewed in FIG. 6 is in the slush-discharging mode. In the slush-discharging mode, the refrigerant is sprayed into the evaporator block 22 from the refrigerant spray nozzle 19 to heat the freezing tube 20 at a low temperature by opening the refrigerant switch-over valve 18 in a state where the suction damper 16 is closed so that the suction sub-pipe 17 can be closed. The sherbet-like slush generated from the low-temperature heat accumulating solution is forced out of the freezing tube 20 and thereby replaced with a low-temperature heat accumulating solution by the opening of the low-temperature heat accumulating solution switch-over valve 28.

In the above-described freezing system, only the refrigerating machine 11 is operated during the daytime cooled solution operation which requires no low-temperature heat accumulating operation, and this enables the secondary side cooled solution of the closed system connected to the evaporator 13 of the refrigerating machine 11 to be directly cooled to about 5° C.

During the low-temperature heat accumulating solution cooling operation which is conducted in summer, cooling can be performed in two stages; a general cooling in which about 5° C. is obtained and a low-temperature cooling in which about 0° C. is obtained In both operations, both of the compressors 11 and 15 are operated in series, and the low-temperature heat accumulating solution is filled into all the evaporator blocks 22 of the freezing section.

In winter, the above-described freezing system may be operated as a heat pump machine. In this way, the heat-accumulation efficiency can be greatly improved because of the relatively low-temperature heat-accumulation, and use of the relatively low-temperature waste heat expelled from a building can be made possible.

In the morning, heating load is large. In that case, if the heat accumulating solution has a temperature, for example, 15° C. or above as the consequence of heating by another heating source in the middle of night, heat can be effectively withdrawn from the condenser 12 by causing the heat accumulating solution to flow in the evaporator blocks 22 of the freezing section and by operating only the compressor 11 of the refrigerating machine section.

In a case where heat is collected from the cooled heat accumulating solution immediately after the heating operation has been started, heat can be withdrawn more effectively from the condenser 12 than in the case of the air heat source type heat pump machine by operating the freezing system in the same manner as that in which it is operated for the low-temperature cooled solution operation or the freezing operation which are conducted in summer.

When the temperature of the heat accumulating solution lowers in the vicinity of 0° C., recovery of waste heat from the building, such as a sewer system, heat collection from atmosphere, recovery of waste heat from the indoor air conditioner and so on are enabled. These ensure a high heat efficiency even in winter. Thermal insulation of the heat-accumulating solution tank can be made simple and the operation of the system can be switched over easily between heating and cooling operations at the turn of the seasons because of relatively low-temperature heat accumulation as compared with the conventional cooled solution relatively low-temperature heat accumulating system.

When the above-described freezing system according to the present invention is used as a cooling/heating heat source, several important operation patterns thereof can be smoothly switched-over so as to achieve the effective operation of the system, e.g., the cooled solution in the closed secondary side can be directly cooled during the general cooled solution operation conducted in a daytime.

Figure 8:
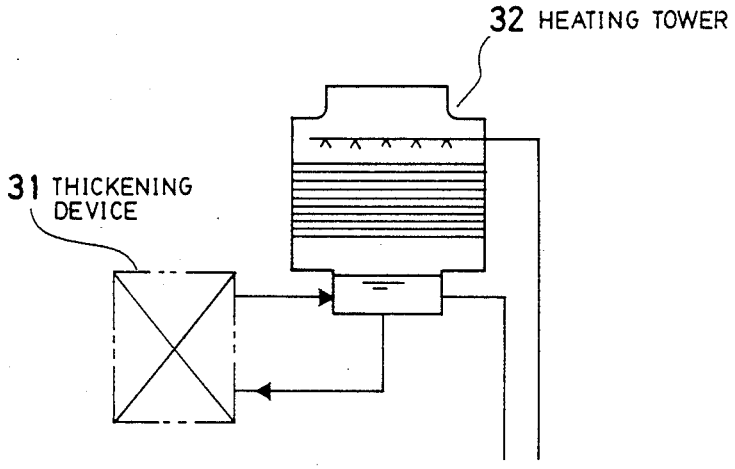
FIG. 8 shows a heating tower whose circulating solution is thickened by the freezing unit according to the present invention.

FIG. 8 shows an example of application of the freezing unit according to the present invention to a thickening device for thickening the circulating solution of a heating tower. Since the circulating solution in a heating tower 32 is directly exposed to the air, it withdraws the water vapor in the air and is therefore diluted with it. The above-described freezing unit according to the present invention may be used as a circulating solution thickening device 31. This thickening device 31 utilizes a cycle of freezing and slush-discharging operations. The water contents mixed into the circulating solution by the operation of a heat pump is frozen in the form of a sherbet-like slush in the freezing operation whose temperature is determined according to the concentration of the circulating solution, and the slush is removed at a temperature determined by the concentration of the solution by, for example, scooping it so as to obtain a circulating solution having a desire concentration.

Figure 1:
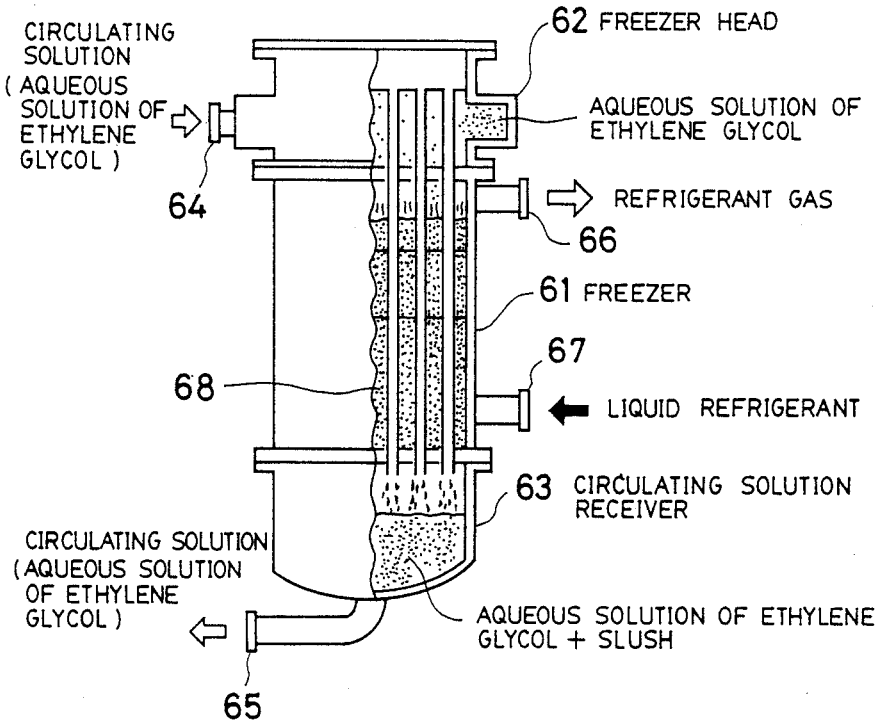
FIG. 1 PRIOR ART
FIG. 1 shows a conventional thin-film dropping type freezing system.
Figure 10:
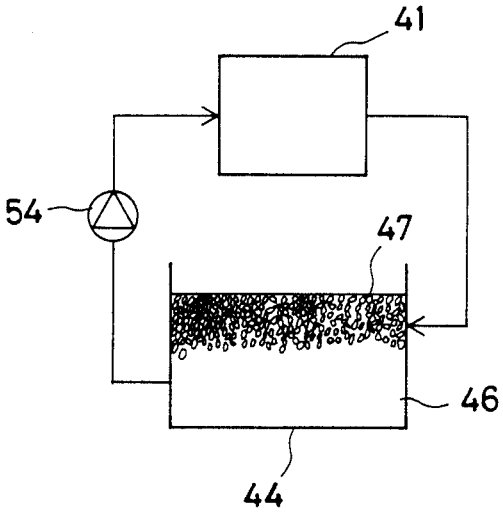
FIG. 10 shows another example of the heat source system of FIG. 9.
Figure 2:
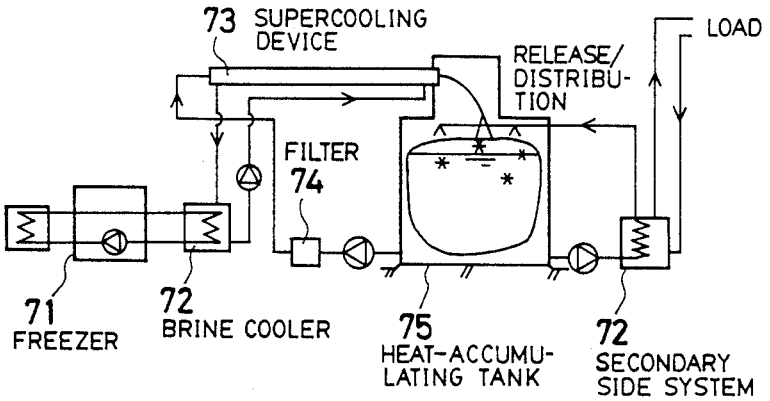
FIG. 2 PRIOR ART
FIG. 2 shows a conventional freezing system of the type which utilizes the supercooling effect of water.
Figure 9A:
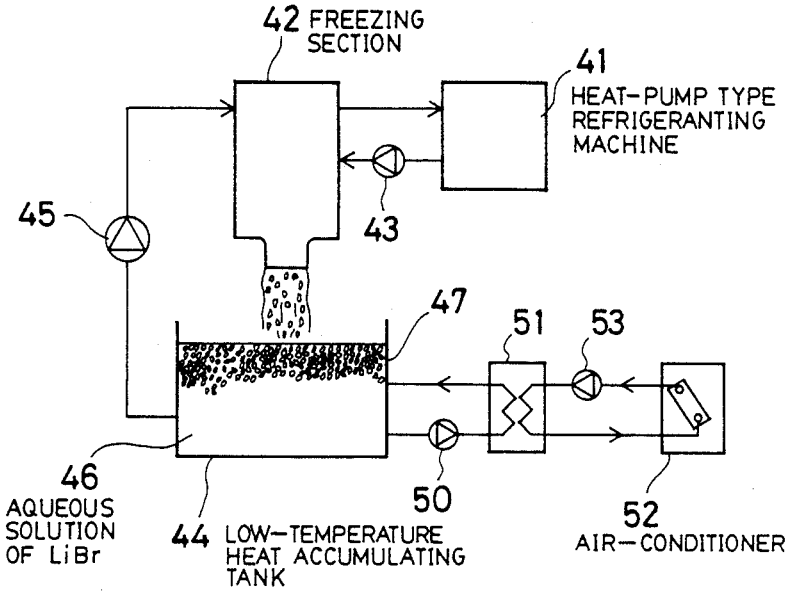
FIGS. 9(*a*) and 9(*b*) shows a heat source system.
Figure 9B:
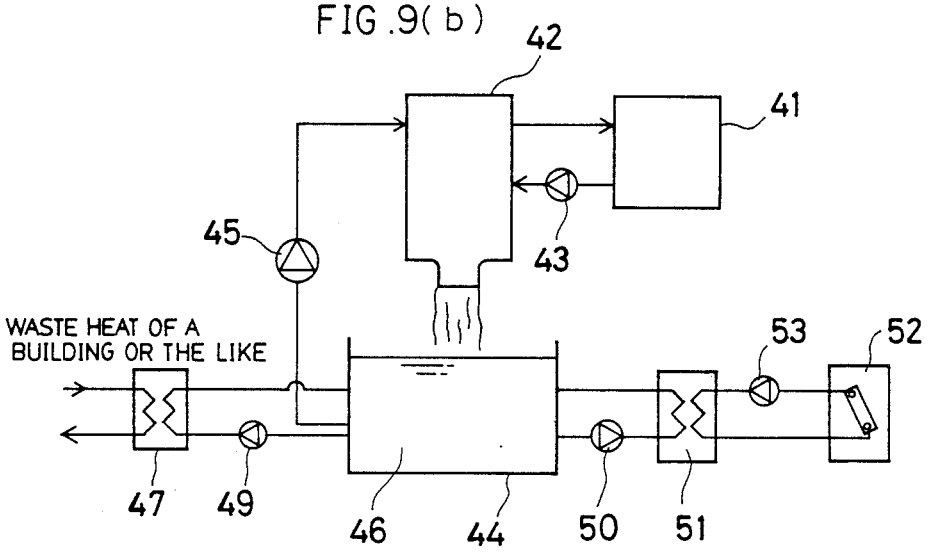

FIGS. 9 and 10 show a heat source system to which the present invention is applied. In FIGS. 9 and 10, a reference numeral 41 denotes a heat pump type refrigerating machine, which operates in a known refrigerating cycle and which involves a compressor, a cooling/heating switch-over valve, a heat source side heat exchanger, a flow restricting valve, and a heat exchanger. A freezing section 42 is a heat exchanger connected to the heat source side heat exchanger of the heat pump type refrigerating machine 41 through piping so that a brine can be circulated between the heat source side heat exchanger and the freezing section by a circulating pump 43. A heat-accumulating tank 44 is connected to the heat exchanger which constitutes the freezing section 42 through piping so that a heat-accumulating material 46 in the heat-accumulating tank 44 can be sprayed into the freezing section 42 by a spraying pump 45. An aqueous solution of bromide having a concentration of several percents is used as the heat-accumulating material 46.

Bromide dissolved in the water includes bromide combined with a light metal, such as lithium bromide or magnesium bromide. An aqueous solution of bromide may be that from which a deca-hydrate can be obtained at 0° C. or below. The heat exchanger which constitutes the freezing section 42 may be used as an evaporator when the refrigerant of the heat pump type refrigerating machine 41 is caused to directly flow into it. In that case, no circulating pump 43 is necessary.

The operation of the cooling/heating heat source system arranged in the manner described above will be described below.

In the cooling cycle, the aqueous solution of bromide 46 is sprayed into the heat exchanger which constitutes the freezing section by the spraying pump 45, where it exchanges heat with the brine or the refrigerant cooled by the heat pump type refrigerating machine 41, the cooled aqueous solution of bromide 46 being returned to the low-temperature heat-accumulating tank 44, as shown in FIG. 9 (*a*). By repeating these processes, a sherbet-like slush 47, which is generated in the circulating solution or on the freezing surface of the freezing section 42, is directly forced into the low-temperature heat accumulating tank 44 or is peeled from the freezing surface and then stored in the low-temperature heat accumulating tank 44. This results in the accumulation of a large amount of low-temperature heat in the low-temperature heat accumulating tank 44 by virtue of the latent heat of water. When the cold heat thus accumulated is to be released, it is fed as a heat source for a cooling system to an air conditioner 52 through an heat exchanger 51 by secondary side pumps 50 and 53. The cold heat may directly be sent to the air conditioner 52 without being passed through the heat exchanger 51.

In the heating cycle, the aqueous solution of bromide 46 is directly or indirectly heated by the heat generated by the heat pump type refrigerating machine 41 in the freezing section 42 which operates as either a condenser or a heating heat exchanger during the heat accumulation operation, as shown in FIG. 9 (*b*). Alternatively, the aqueous solution of bromide 46 in the heat accumulating tank 44 is circulated between a heat exchanger 47 and the heat accumulating tank 46 by a circulating pump 49. In the heat exchanger 47, the aqueous solution absorbs the waste heat of a building or heat in the air. When the relatively low-temperature heat thus accumulated in the heat-accumulating tank is to be released, it is fed as a heat source by the spraying pump 45 to the freezing section 42 which is switched over to operate as an evaporator or a heat collecting heat exchanger, where it is directly transferred to the refrigerant of the heat pump type refrigerating machine 41 or is indirectly transferred to the brine.

FIG. 10 shows another example of a heat source system. In this system, the aqueous solution of bromide 46 is fed to an evaporator side heat exchanger or an indirect heat exchanger of the heat pump type refrigerating machine 41 by a circulating pump 54 for heat exchange. In the cooling cycle, the sherbet-like slush 47 is directly stored in the low-temperature heat accumulating tank 44 in the same manner as that of the above-described example.

The above-described examples employ an aqueous solution of bromide as a heat or cold heat source of the heat pump type refrigerating machine 41. Since the aqueous solution of bromide is substantially innocuous and is not therefore listed as an industrial waste, it may also be used as a non-freezing circulating solution for an open type heating tower in which sensible heat is collected from a low-temperature air, as stated above.

In a so-called Harvest type icy cold heat accumulating system, slush is accumulated in the manner described below: A low-temperature heat accumulating solution is sprayed over a freezing plate. Each time the thickness of the slush reaches a predetermined value, a hot gaseous refrigerant or a heated brine is automatically caused to flow into the freezing plate only for a short period of time to heat the freezing plate and thereby peel the slush therefrom. In this system, a sherbet-like slush can be formed without greatly varying the freezing temperature by employing a low-temperature heat accumulating solution containing a small amount of bromide. This is achieved because an aqueous solution of bromide having a concentration of several percents can readily freeze at a relatively high temperature. Thus, the time required to discharge slush can be reduced, slush-discharge failure can be greatly reduced, and the fluidity of slush within the low-temperature heat accumulating tank or the piping can be improved.

Since the amount of slush in the low-temperature heat accumulating tank and the concentration of the aqueous solution of bromide have a certain relation, if management of the concentration of the solution is performed, measurement of the amount of slush performed at intervals of a short period of time can be made simple. This results in the provision of a Harvest type icy low-temperature heat accumulating system in which a cooling-/heating heat source system can be optimally operated at a low cost according to the cooling/heating load of a building.

As will be understood from the foregoing description, in the present invention, sherbet-like slush can be generated at a relatively high temperature, e.g., at about −5° C., by using an aqueous solution of bromide, such as lithium bromide, having a low concentration as a low-temperature heat accumulating material Furthermore, since the aqueous solution of bromide does not become a hard mass of ice for a long period of time by virtue of the depression of freezing point and a high hydration ability, the tube is not frozen, which would occur when water is frozen. The slush can be removed from the freezing surface smoothly in a short time by heating the tube at a low temperature, e.g., at about 0° C. This enables heat of a precooled low-temperature heat accumulating material or the heat absorbed by a precooled high-pressure normal-temperature refrigerant liquid which is not yet passed through an evaporator to be utilized as an slush-discharging heat, thereby improving the operation efficiency and making the overall refrigerating system simpler.

Furthermore, an aqueous solution of bromide having a low concentration is used as a low-temperature heat accumulating material This is safer than an aqueous solution of ethylene glycol or the like employed in a conventional freezing system, and therefore ensures an improved maintenance and reduction in the production cost. Furthermore, the aqueous solution of bromide having a low concentration freezes at a relatively high temperature of about −1° C., and a refrigerant direct expansion system can be utilized. These increase the vaporization temperature in a refrigerating machine by about 5° C. as compared with the conventional system, and thus improves the freezing efficiency.

Since the slush is generated from the solution in a stationary state within the tubes, power is required only when the solution is filled into the tubes to discharge the slush. The solution filling time is about one tenth of the overall operating time or less. As a result, the power can be reduced to one fifth to one tenth of that required in the conventional system.

In a case where the freezing unit according to the present invention is used as a circulating solution thickening device for a heating tower, so long as no heat recovering heat exchanger is provided, the amount of energy can be reduced to about one seventh of that required when the vaporization latent heat is utilized, due to the use of heat of solidification. The mechanism of the thickening device can be made simpler, thereby making the overall system simple.

What is claimed is:

1. A freezing method for transferring heat by means of a low-temperature heat accumulating solution comprising the steps of:

(a) filling an aqueous solution of bromide having a low concentration, as a heat accumulating solution, into horizontally arranged tubes of a heat exchanger;

(b) in a freezing mode, retaining said aqueous solution in said tubes in a stationary state while passing a refrigerant at a temperature below 0° C. around said tubes so as to cause formation of a sherbet-like slush of said heat accumulating solution;

(c) in a slush-discharging mode, heating said tubes to substantially 0° C. or above, and refilling the tubes with aqueous bromide solution so as to displace said sherbet-like slush from said tubes to a storage tank; and (d) alternately repeating said freezing mode step and said slush-discharging mode step.

2. The method of claim 1, wherein the heat accumulating solution is an aqueous bromide solution having a concentration of 2 to 3%.

3. The method of claim 2, wherein the heat accumulating solution is an aqueous solution of lithium bromide.

4. The method of claim 1 wherein, in the slush-discharging mode step, heating of said tubes is performed by passing around them refrigerant at a temperature of 0° C. or above.

5. The method of claim 1, wherein said slush-discharging mode step takes place within a time period of one minute or less.

6. The method of claim 1, wherein said heat exchanger includes a plurality of heat exchanger blocks and said method includes the further step of controlling the filling of aqueous bromide solution to the blocks individually such that their slushdischarging modes are operated sequentially.

7. The method of claim 1, wherein the refrigerant of the freezing mode has a temperature of about −5° C.

* * * * *